US006736959B2

(12) United States Patent
Benazzi et al.

(10) Patent No.: US 6,736,959 B2
(45) Date of Patent: May 18, 2004

(54) PROCESS FOR IMPROVING THE POUR POINT OF FEEDS CONTAINING PARAFFINS USING A CATALYST BASED ON A BRIDGED DIOCTAHEDRAL 2:1 PHYLLOSILICATE

(75) Inventors: Eric Benazzi, Chatou (FR); Nathalie Marchal-George, Saint Genis Laval (FR)

(73) Assignee: Institut Francais du Petrole, Rueil-Malmaison (FR)

( * ) Notice: Subject to any disclaimer, the term of this patent is extended or adjusted under 35 U.S.C. 154(b) by 106 days.

(21) Appl. No.: 09/909,805

(22) Filed: Jul. 23, 2001

(65) Prior Publication Data

US 2002/0170847 A1 Nov. 21, 2002

(30) Foreign Application Priority Data

Jul. 21, 2000 (FR) ..... 00 09642

(51) Int. Cl.[7] ..... C10G 47/02

(52) U.S. Cl. ..... 208/109; 208/108; 208/111.01; 208/111.15; 208/111.1; 208/111.2; 208/111.3; 208/111.25

(58) Field of Search ..... 208/108, 109, 208/111.01, 111.15, 111.1, 111.2, 111.3, 111.25

(56) References Cited

U.S. PATENT DOCUMENTS

| | | | | |
|---|---|---|---|---|
| 5,023,221 A | | 6/1991 | Occelli | 502/66 |
| 5,961,816 A | * | 10/1999 | Benazzi et al. | 208/111.3 |
| 5,997,725 A | | 12/1999 | Benazzi | 208/111.3 |
| 6,139,719 A | * | 10/2000 | Benazzi et al. | 208/111.01 |
| 6,191,333 B1 | * | 2/2001 | Benazzi et al. | 585/749 |
| 6,235,670 B1 | * | 5/2001 | Benazzi et al. | 502/63 |

FOREIGN PATENT DOCUMENTS

| | | | | |
|---|---|---|---|---|
| EP | 811671 | | 12/1997 | |
| FR | 2673930 | | 9/1992 | |
| FR | 2771308 | | 5/1999 | |
| JP | 2000-319014 A | * | 11/2000 | C01B/33/44 |
| WO | 98/04345 | | 2/1998 | |

* cited by examiner

*Primary Examiner*—Walter D. Griffin
(74) *Attorney, Agent, or Firm*—Millen, White, Zelano, Branigan, P.C.

(57) ABSTRACT

The invention concerns a process for improving the pour point of a feed comprising paraffins containing more than 10 carbon atoms, in which the feed to be treated is brought into contact with a catalyst. The catalyst comprises at least one dioctahedral 2:1 phyllosilicate, preferably synthesised in a fluoride medium in the presence of the acid HF and/or a further source of fluoride anions, and preferably having an interplanar spacing of at least $20\times10^{-10}$ m (2 nm) and comprising pillars based on at least one oxide of elements from groups IVB, VB, VIB, VIII, IB, IIB, IIA or IVA or any combination of these oxides, and preferably selected from the group $SiO_2$, $Al_2O_3$, $TiO_2$, $ZrO_2$ and $V_2O_5$, or any combination of these latter. The catalyst further comprises at least one hydrodehydrogenating element in the metallic form. The process is carried out at a temperature in the range 170° C. to 500° C., a pressure in the range 1 to 250 bar and at an hourly space velocity in the range 0.05 to 100 $h^{-1}$, in the presence of hydrogen in an amount of 50 to 2000 1/1 of feed. The oils obtained have good pour points and high viscosity indices (VI). The process is also applicable to gas oils and to other feeds requiring a reduction in their pour point.

36 Claims, No Drawings

PROCESS FOR IMPROVING THE POUR POINT OF FEEDS CONTAINING PARAFFINS USING A CATALYST BASED ON A BRIDGED DIOCTAHEDRAL 2:1 PHYLLOSILICATE

The present invention concerns a process for improving the pour point of feeds containing straight chain and/or slightly branched, long chain (more than 10 carbon atoms) paraffins, in particular to provide good yields on converting feeds with high pour points into at least one cut with a low pour point and a high viscosity index.

High quality lubricants are of fundamental importance to the proper operation of modern machines, automobiles and trucks. However, the quantity of paraffins originating directly from untreated crude oil with properties that are suitable for use in good lubricants is very low with respect to the increasing demand in this sector.

Heavy oil fractions containing large amounts of straight chain or slightly branched paraffins must be treated in order to obtain good quality oil bases in the best possible yields, employing an operation that aims to eliminate the straight chain or slightly branched paraffins from feeds which are then used as base stock, or as kerosene or jet fuel.

High molecular weight paraffins that are straight chain or very slightly branched and are present in the oils or kerosene or jet fuel lead to high pour points and thus to coagulation for low temperature applications. In order to reduce the pour points, such straight chain paraffins that are not or are only slightly branched must be completely or partially eliminated.

That operation can be carried out by extracting with solvents such as propane or methyl ethyl ketone, termed dewaxing, with propane or methyl ethyl ketone (MEK). However, such techniques are expensive, lengthy and not always easy to carry out.

A further technique is catalytic treatment; zeolites are among the most widely used catalysts because of their form selectivity.

Zeolite based catalysts such as ZSM-5, ZSM-11, ZSM-12, ZSM-22, ZSM-23, ZSM-35 and ZSM-38 have been described for their use in such processes.

The Applicant has directed its research towards developing alternative processes for improving the pour point of feeds, using different catalysts.

SUMMARY OF THE INVENTION

The invention concerns a process for improving the pour point of a feed comprising paraffins containing more than 10 carbon atoms, in which the feed is brought into contact with a catalyst comprising at least one dioctahedral 2:1 phyllosilicate and at least one hydrodehydrogenation element, in general in the metallic form.

Preferably, the phyllosilicate contains fluorine; it has been synthesised in a fluoride medium in the presence of HF and/or a further source of fluoride anions.

Advantageously, the interplanar spacing is at least $20\times10^{-10}$ m (2 nm) and preferably, the space between the phyllosilicate sheets comprises pillars based on at least one oxide of elements from groups IVB, VB, VIB, VIII, IB, IIB, IIA, IVA or any combination of these oxides, preferably selected from the group formed by $SiO_2$, $Al_2O_3$, $TiO_2$, $ZrO_2$ and $V_2O_5$, or any combination of the latter.

The process can advantageously convert a feed with a high pour point to a mixture (for example oil) with a lower pour point and, in the case of oil, a high viscosity index. It can also be applied to reducing the pour point of gas oils, for example.

The feed is composed, inter alia, of straight chain and/or slightly branched paraffins containing at least 10 carbon atoms, preferably 15 to 50 carbon atoms, and advantageously 15 to 40 carbon atoms.

The catalyst comprises at least one hydrodehydrogenation element, for example at least one group VIII metal (Fe, Co, Ni, Ru, Rh, Pd, Os, Ir, Pt) or a combination of at least one group VIII (non noble) metal or compound and at least one group VIB metal or compound, and the reaction is carried out under conditions which will be described below.

Advantageously, the catalyst also contains a matrix.

The use of a dioctahedral 2:1 phyllosilicate, preferably synthesised in a fluoride medium in the presence of the acid HF and/or a further source of fluoride anions, wherein the interplanar spacing is at least $20\times10^{-10}$ m (2 nm) and comprising pillars based on at least one oxide of elements from groups IVB, VB, VIB, VIII, IB, IIB, IIA and IVA or any combination of these oxides, preferably selected from the group formed by $SiO_2$, $Al_2O_3$, $TiO_2$, $ZrO_2$ and $V_2O_5$, or any combination of these latter, and at least one group VIII element can result in good yields of products with a low pour point and a high viscosity index.

The interplanar spacing $d_{001}$ of the dioctahedral 2:1 phyllosilicates (preferably previously to prepared in a fluoride medium in the presence of the acid HF and/or another source of fluoride ions), preferably bridged by employing the process described above, is at least $20\times10^{-10}$ m, preferably at least $26.5\times10^{-10}$ m, more preferably more than $28\times10^{-10}$ m and still more preferably at least $30\times10^{-10}$ m or even $33\times10^{-10}$ m. Said interplanar spacing is generally $60\times10^{-10}$ m or less, preferably $50\times10^{-10}$ m or less. Said interplanar spacing, represented by $d_{001}$, represents the sum of the thickness of a sheet plus the space between the sheets. This value can be obtained directly using a conventional orientated powder X ray diffraction method.

Dioctahedral 2:1 phyllosilicates are minerals that are formed by layers of elementary sheets. Although the chemical bonds between the elements of the phyllosilicate structure are ionocovalent, they will be assumed to be ionic, to simplify the description.

From a representation where the $O^{2-}$ ions are in a plane in contact with each other, it is possible to produce a plane with a hexagonal cavity, termed the hexagonal plane, by withdrawing alternate $O^{2-}$ ions from alternate rows of $O^{2-}$ ions.

The structure of a phyllite can be simply represented by arrangements of hexagonal planes of $O^{2-}$ ions and compact planes of $O^{2-}$ and $OH^-$ ions. The $OH^-$ ions fill the cavities in the hexagonal planes of $O^{2-}$ ions.

Superimposing two compact planes sandwiched by hexagonal planes defines an octahedral layer (O) between two tetrahedral layers (T) giving the sheet the denomination TOT.

Such an arrangement, also termed 2:1, defines a plane of octahedral cavities located in the octahedral layer between two planes of tetrahedral cavities, one in each tetrahedral layer. Each tetrahedron has one $O^{2-}$ ion in common with the octahedral layer and each of the three other $O^{2-}$ ions is shared with another tetrahedron in the same tetrahedral layer.

The crystalline lattice is thus constituted by 6 octahedral cavities each having 4 tetrahedral cavities either side. In the case of a phyllite constituted by the elements Si, Al, O, H, such an arrangement corresponds to the ideal formula $Si_8(Al_{4\circ2})O_{20}(OH)_4$. The tetrahedral cavities contain the element silicon, and the octahedral cavities contain the element aluminium but in this case one octahedral cavity in three is empty (○). Such an assembly is electrically neutral. Usually, the half-cell is used, with formula $$Si_4(Al_2\circ)O_{10}(OH)_2$$

The tetrahedral element silicon can be substituted by trivalent elements such as aluminium or gallium or iron ($Fe^{3+}$). Similarly, the octahedral element aluminium can be substituted by:

the trivalent elements cited above, or a mixture of those elements;

divalent elements such as (Mg).

These substitutions endow the structure with a negative charge. This necessitates the existence of exchangeable compensating cations located in the space between the sheets. The thickness of the space between the sheets depends on the nature of the compensating cations and their hydration. That space is also capable of accepting other chemical species such as water, amines, salts, alcohols, bases, etc.

The existence of —OH groups causes thermal instability due to a dehydroxylation reaction with equation: 2-OH→—O—+$H_2O$. In this respect, the introduction of the element fluorine into the structure during synthesis in place of the O—H groups produces phyllosilicates with greatly improved thermal stability.

The general chemical formula (for a half-cell) of dioctahedral 2:1 phyllosilicates, preferably synthesized in a fluoride medium in the presence of HF acid and/or another source of fluoride anions, before bridging is as follows:

$$M^{m+}_{x/m}((Si_{(4-x)}T_x(T_2\square_1)O_{10}(OH_{(2-y)}F_y)^{x-}$$

where

T represents an element selected from the group formed by elements from group IIIA (such as B, Al, Ga) and iron;

M is at least one compensating cation selected from the group formed by cations of elements from groups IA, IIA and VIII, organic cations containing nitrogen, the ammonium cation, and rare earth cations. The cation originates from the reaction medium or is introduced by at least one exchange process. Advantageously, the cation from the reaction medium is selected from the group formed by alkalis (except lithium), the ammonium cation ($NH_4^+$), organic cations containing nitrogen (including alkylammonium and arylammonium) and organic cations containing phosphorous (including alkylphosphonium and arylphosphonium). M can also be a compensating cation introduced by post-synthesis ion exchange, selected from the group formed by cations of elements from groups IA, IIA and VIII of the periodic table, rare earth cations (cations of elements with atomic number 57 to 71 inclusive), organic cations containing nitrogen (including alkylammonium and arylammonium) and the ammonium cation;

m is the valency of cation M;

x is a number in the range 0 to 2, preferably in the range 0.1 to 0.8;

y greater than 0, preferably in the range in the range 0 to 2; highly preferably, y is greater than 0 and 2 or less;

□ represents an octahedral cavity.

The X ray diffraction diagram of the dioctahedral 2:1 phyllosilicate before bridging is characterised by the presence of the following lines:

a characterising line, $d_{060}$, at $1.49\pm0.01\times10^{-10}$ m for a dioctahedral 2:1 phyllosilicate comprising an octahedral layer with the composition ($Al_2\square$);

at least one 001 reflection such that $d_{001}$ is $12.5\pm3\times10^{-10}$ m depending on the nature of the compensating cation and its hydration at the humidity under consideration.

Preferably, the fluorine content in the phyllosilicate is such that the mole ratio F/Si=y/(4−x) is in the range 0.1 to 4, preferably in the range of about 0.1 to 2.

The dioctahedral 2:1 phyllosilicate also exhibits at least one signal in $^{19}F$ NMR, with magic angle spinning, determined as is well known to the skilled person. The chemical displacement of this signal also depends on the composition of the octahedral layer. Thus it corresponds to a value of:

133 ppm (±5 ppm) for $^{19}F$ NMR with magic angle spinning when the nearest neighbours of the fluorine atom are two aluminium atoms, corresponding to an octahedral layer with the composition ($Al_2\square$);

108 ppm (±5 ppm) for $^{19}F$ NMR with magic angle spinning when the nearest neighbours of the fluorine atom are two gallium atoms, corresponding to an octahedral layer with the composition ($Ga_2\square$);

118 ppm (±5 ppm) for $^{19}F$ NMR with magic angle spinning when the nearest neighbours of the fluorine atom are an aluminium atom and a gallium atom, corresponding to an octahedral layer with the composition (Ga, Al□).

Said phyllosilicates are advantageously synthesised in a fluoride medium in the presence of the acid HF and/or another source of fluoride anions and at a pH of less than 9, preferably in the range of about 0.5 to about 6.5.

The preparation of these types of solids in a fluoride medium and their characterisation are described in the following references, the disclosures of which are hereby included in the present description: French patent FR-A-2 673 930, a publication of the 202$^{nd}$ meeting of the American Chemical Society (ACS) in New York in August 1991, published in "Synthesis of Microporous Materials, Extended Clays and Other Microporous Solids" (1992), and a report of the "Academie des Sciences Paris, t. 315, Series II, p. 545–549, 1992.

The dioctahedral 2:1 phyllosilicates described above can advantageously contain fluorine and are bridged, for example using a novel process comprising the following steps:

The dioctahedral 2:1 phyllosilicate, preferably in its ammonium form ($NH_4^+$), is suspended in a solution of a surfactant with a concentration in the range 0.01 mole/liter to 1 mole/liter, preferably in the range of about 0.05 to about 0.7 mole/liter. Suitable surfactants for use in this step are anionic surfactants, non limiting examples of which are alkylsulphates and alkylsulphonates, or cationic surfactants, including tetraalkylammonium halides or hydroxides such as cetyltrimethylammonium chloride or geminal alkylammonium compounds. Examples are hexadecyltrimethylammonium bromide, ethylhexadecyldimethylammonium bromide, octadecyltrimethylammonium bromide, dodecyltrimethylammonium bromide, and didodecyldimethylammonium bromide. Other surfactants can also be used, for example triton X-100, polyethylene oxide (POE).

After a contact period, during which the medium is stirred, for example, for between 5 minutes and 12 hours, preferably between about 15 minutes and about 6 hours, and more preferably about 15 minutes to about 3 hours, the medium is filtered then washed with distilled water and finally dried in air or an inert gas, for example at a temperature in the range 40° C. to 150° C.; for a period in the range 5 minutes to 24 hours, preferably in the range of about 30 minutes to about 12 hours.

When the phyllosilicate is not in the ammonium form, it can first undergo any treatment that is known to the skilled person to obtain the dioctahedral 2:1 phyllosilicate mainly in its ammonium form. A non limiting example of a treatment to carry out this transformation is an ion exchange step using aqueous solutions of an ammonium salt (ammonium nitrate and/or ammonium chloride).

The dioctahedral 2:1 phyllosilicate treated using the operating procedure described in the preceding step is then brought into contact with a mixture comprising:

(i) at least one $RNH_2$ type primary amine or a R'RNH secondary amine, where R' and R are advantageously selected from the group formed by carbon-containing groups, alkyl, isoalkyl and naphthenyl groups, and aromatic groups that may or may not be substituted with other groups and that may contain 1 to 16 carbon atoms;

(ii) at least one alkoxide of an element or a mixture of alkoxides, the element being selected from the group formed by elements from groups IVB, VB, VIB, VIII, IB, IIB, preferably silicon, aluminium, zirconium, titanium or vanadium, with general formula $M(OR)_n$, where M is the element described above, n is the valency of said element and R is a group advantageously selected from the group formed by alkyl, isoalkyl and naphthenyl groups and aromatic groups that may or may not be substituted. The different groups —OR may be identical or different depending on the nature of group R selected from the group defined above.

It is left in contact, preferably with stirring, for example for a period in the range 5 minutes to 12 hours, preferably in the range of about 5 minutes to about 8 hours.

(iii) The bridged dioctahedral 2:1 phyllosilicate is then filtered and dried in air or in an inert gas, for example at a temperature in the range 40° C. to 150° C., for a period in the range 5 minutes to 24 hours, preferably in the range of about 30 minutes to to about 12 hours.

This bridging process can simply and rapidly introduce pillars based on at least one oxide of elements from groups IVB, VB, VIB, VIII, IB, IIB, IIA, IVA or a combination of these oxides, preferably based on at least one compound selected from the group formed by $SiO_2$, $Al_2O_3$, $TiO_2$, $ZrO_2$ and $V_2O_5$ or any combination of these latter, said pillars being located in the space between the sheets of the dioctahedral 2:1 phyllosilicates, prepared in a fluoride medium.

In order to obtain the oxide pillars, a calcining step is carried out after bridging (step (iii)) at a temperature generally in the range 450–800° C. The choice of temperature depends on the nature of the pillar element.

The dioctahedral 2:1 phyllosilicate of the invention generally contains at least one hydrodehydrogenating element, for example at least one group VIII metal, preferably a noble metal and advantageously selected from the group formed by Pt and Pd, which is introduced by dry impregnation, for example, by ion exchange or any other method that it known to the skilled person.

The amount of metal introduced, expressed as the % by weight with respect to the amount of phyllosilicate engaged, is generally less than 5%, preferably less than about 3% and generally of the order of about 0.5% to about 1% by weight.

When treating a real feed, the phyllosilicate of the invention is generally first formed. In a first variation, the phyllosilicate can have at least one group VIII metal deposited on it, preferably selected from the group formed by platinum and palladium, and it can be formed by any technique that is known to the skilled person. In particular, it can be mixed with a matrix, which is generally amorphous, for example a moist alumina gel powder. The mixture is then formed, for example by extrusion through a die. The amount of phyllosilicate in the mixture obtained is generally in the range 0.5% to 99.9%, advantageously in the range of about 5% to about 90% by weight, with respect to the mixture (phyllosilicate+matrix).

In the remaining text, the term "support" is used to describe the phyllosilicate+matrix mixture.

Forming can be carried out with matrices other than alumina, such as magnesia, amorphous silica-aluminas, silica, titanium oxide, boron oxide, zirconia, aluminium phosphates, titanium phosphates, zirconium phosphates, charcoal, and mixtures thereof. Techniques other than extrusion can be used, such as pelletization or bowl granulation.

The group VIII hydrogenating metal, advantageously a noble metal, preferably Pt and/or Pd, can also be deposited on the support using any process that is known to the skilled person for depositing metal on the phyllosilicate. In the case of platinum or palladium, a platinum tetramine or a palladium tetramine complex is normally used, optionally in the presence of ammonium nitrate, for example (competing agent). Hexachloroplatinic acid, hexachloropalladic acid and/or palladium chloride can also be used, optionally in the presence of a competing agent, for example hydrochloric acid. Deposition of the group VIII metal (or metals) is generally followed by calcining in air or oxygen, usually in the range 300° C. to 600° C. for 0.5 to 10 hours, preferably in the range of about 350° C. to about 550° C. for for about 1 to about 4 hours. Reduction in hydrogen can then be carried out, generally at a temperature in the range 300° C. to 600° C. for 1 to 10 hours, preferably in the range of about 350° C. to about 550° C. for about 2 to about 5 hours.

The hydro-dehydrogenating element can also be a combination of at least one group VI metal or compound (for example molybdenum or tungsten) and at least one group VIII metal or compound (for example nickel or cobalt). The total concentration of group VI and group VIII metals, expressed as the metal oxides with respect to the support, is generally in the range 5% to 40% by weight, preferably in the range of about 7% to about 30% by weight. The weight ratio (expressed as the metallic oxides) of group VIII metals to group VI metals is preferably in the range 0.05 to 0.8: more preferably in the range of about 0.13 to 0.5.

Methods that are known to the skilled person can be employed to deposit these metals.

This type of catalyst can advantageously contain phosphorous, the content of which is generally less than 15% by weight, preferably less than about 10% by weight, expressed as phosphorous oxide $P_2O_5$ with respect to the support.

Feeds that can be treated using the process of the invention are advantageously fractions with relatively high pour points the values of which are to be reduced. They are paraffin feeds that comprise paraffins containing more than 10 carbon atoms, generally more than 12 carbon atoms, and in the case of heavier feeds, high molecular weight paraffins.

The process of the invention can be used to treat a variety of feeds, from relatively light fractions such as kerosenes and jet fuels to feeds with higher boiling points such as middle distillates, vacuum residues, gas oils, middle distillates from FCC (LCO and HCO) and hydrocracking residues.

The feed to be treated is, for the most part, a cut with an initial boiling point of more than about 175° C., usually a $C_{10}^{+}$ cut, preferably a heavy cut with a boiling point of at least 280° C., advantageously a boiling point of at least 380° C. The process of the invention is particularly suitable for treating paraffinic distillates such as middle distillates which encompass gas oils, kerosenes, jet fuels, vacuum distillates and all other fractions with a pour point and viscosity which must be adapted to satisfy specifications.

Non limiting examples of other feeds which can be treated in accordance with the invention are bases for lubricating oils, synthesised paraffins from the Fischer-Tropsch process, high pour point polyalphaolefins, synthesised oils, and other similar feeds. The process can also be applied to other compounds containing an n-alkane chain such as those defined above, for example n-alkylcycloalkanes, or containing at least one aromatic group.

Feeds that can be treated using the process of the invention can contain paraffins, olefins, naphthenes, aromatics and heterocycles and can have a high proportion of high molecular weight n-paraffins and very slightly branched paraffins, also of high molecular weight.

Typical feeds that can advantageously be treated by the process of the invention generally have a pour point of more than 0° C. The products resulting from treatment in accordance with the process have pour points of below 0° C., preferably below about −10° C.

These feeds contain more than 30% and up to about 90%, in some cases more than 90% of n-paraffins containing more than 10 carbon atoms and very slightly branched paraffins containing more than 10 carbon atoms. The process is of particular advantage when this proportion is at least 60% by weight.

The process of the invention is carried out under the following operating conditions:

- the reaction temperature is in the range 170° C. to 500° C., preferably in the range of about 180° C. to about 470° C., advantageously about 190° C. to about 450° C.;
- the pressure is in the range 1 to 250 bar, preferably in the range of about 10 to about 200 bar;
- the hourly space velocity (HSV expressed as the volume of feed injected per unit volume of catalyst per hour) is in the range of about 0.05 to about 100, preferably about 0.1 to about 30 $h^{-1}$.

The feed and the catalyst are brought into contact in the presence of hydrogen. The amount of hydrogen used, expressed in liters of hydrogen per liter of feed, is in the range of 50 to 2000 liters of hydrogen per liter of feed, preferably in the range of about 100 to 1500 liters of hydrogen per liter of feed.

The quantity of nitrogen compounds in the feed to be treated is preferably less than about 200 ppm by weight, more preferably less than about 100 ppm by weight. The sulphur content is below 1000 ppm by weight, preferably less than about 500 ppm, more preferably less than about 200 ppm by weight. The quantity of metals in the feed, such as Ni or V, is extremely low, i.e., less than 50 ppm by weight, preferably less than about 10 ppm by weight and more preferably less than 2 ppm by weight. Thus, this feed usually undergoes an initial hydrotreatment prior to being used in the process of the invention.

The use of dioctahedral 2:1 phyllosilicate with a large interplanar spacing as described here can produce oils with a good pour point (and in general with a VI of at least 95 or even 115) and gas oils with an improved pour point.

EXAMPLES

Example 1

Preparation of a Bridged Dioctahedral 2:1 Phyllosilicate (PDP1), a Beidellite in the Sodium Form, used in the Composition of Catalyst C1

The following were successively added to 36 g of distilled water as indicated:

- 0.31 g of the salt NaF (Prolabo), with moderate stirring;
- 0.66 g of the acid HF, 40% (Flulka);
- 2.35 g of the hydrated oxyhydroxide AlOOH (Catapal B Vista), with vigorous stirring;
- 2.50 g of powdered $SiO_2$ oxide (Aerosil 130 from Degussa), with moderate stirring.

The composition of the hydrogel thus prepared, with respect to one mole of oxide $SiO_2$, was:

$$1.0SiO_2;\ 0.382Al_2O_3;\ 0.177NaF;\ 0.20HF;\ 48H_2O$$

giving, in molar terms:

| | |
|---|---|
| Si/Al | = 1.309 |
| $Na^+$/Si | = 0.177 |
| F/Si | = 0.377 |
| HF/Si | = 0.20 |
| $H_2O$/Si | = 48 |

This composition did not take into account the water provided by the aluminium source and the acid HF.

The hydrogel obtained was aged for 4 hours at ambient temperature (20° C.) with moderate stirring. The pH was close to 5.

Crystallisation was then carried out at 220° C. in a 120 ml steel autoclave lined with a polytetrafluoroethylene (Teflon) coating, under autogenous pressure, for 168 hours, without stirring. The autoclave was then cooled in air. The pH at the end of the synthesis was about 4.

The product was recovered, filtered and washed with copious quantities of distilled water. It was then dried at 40–50° C. for 24 hours. After 24 hours, the product obtained, with 50% relative humidity, was characterised by its X ray diffraction spectrum, shown below (Table 1).

| $d_{hkl}$ ($10^{-10}$ m) | $I/I_0$ |
|---|---|
| 12.42 | 100 |
| 6.22 | 6 |
| 4.46 | 55 |
| 2.55 | 21 |
| 2.48 | 15 |
| 2.25 | 2 |
| 2.22 | 3.5 |
| 1.74 | 5 |
| 1.73 | 6 |
| 1.69 | 13 |
| 1.66 | 7 |
| 1.62 | 2 |
| 1.49 | 20 |

The fluorine content of the phyllosilicate obtained was 3.15% by weight. $^{19}F$ NMR with magic angle spinning of the phyllosilicate prepared in this example showed that a signal was present at −133 ppm.

The prepared solid then underwent three successive ion exchange steps using a solution of ammonium nitrate to obtain the $NH_4^+$ form of the phyllosilicate. To this end, 10 grams of the phyllosilicate prepared as above was suspended in 250 ml of a molar ammonium nitrate solution then stirred under reflux for 2 hours. The solid was then filtered and washed. This cycle of treatment was repeated two more times. The solid obtained was then dried at 60° C. for 10 hours.

The prepared dioctahedral 2:1 phyllosilicate was designated as PD1. This latter then underwent a bridging step as described in the operating protocol below.

8 g of the prepared dioctahedral 2:1 phyllosilicate PD1 in its NH4 form was suspended in 80 ml of a hexadecyltrimethylammonium (CTMA-CI) solution with a concentration of 0.1 M. After stirring for one hour at room temperature, it was filtered, washed with twice 200 ml of distilled water then dried at 60° C. for 8 hours. Sample PD1 previously treated with CTMA was suspended in a mixture composed of 4.48 g of octylamine ($C_8H_{17}NH_2$) and 60.32 g of ethyl tetraorthosilicate $Si(OEt)_4$. After 30 minutes stirring, it was filtered then dried at 60° C. for 8 hours. The sample was calcined at 530° C. for 3 hours in air then for 2 hours in pure oxygen.

The $d_{001}$ of the sample after calcining was $34.6\times10^{-10}$ m (3.46 nm) and its specific surface area was 390 $m^2/g$.

The prepared dioctahedral 2:1 phyllosilicate was termed PDP1.

Example 2

Preparation of Catalyst C1

The PDP1 dioctahedral 2:1 phyllosilicates described in Example 1 was mixed with type SB3 alumina supplied by Condéa. The mixed paste was then extruded through a 1.4 mm die. The amount of bridged clay in the support (phyllosilicate+matrix) was 50% by weight.

Dry impregnation was carried out using a platinum salt $Pt(NH_3)_4Cl_2$ to produce an amount of platinum on the support of 0.6% by weight. The catalyst obtained was termed $C_1$.

Example 3

Preparation of Bridged Dioctahedral 2:1 Phyllosilicate PDP2, a Dioctahedral 2:1 Phyllosilicate in the Ammonium Form, used in the Composition of Catalyst C2

The following were successively added to 36 g of distilled water:

0.385 g of $NH_4F$ salt (Prolabo), with moderate stiring;

0.312 g of the acid HF, 40% (Fluka);

2.71 g of the hydrated oxyhydroxide AlOOH (Catapal B Vista), with vigorous stirring;

2.50 g of powdered $SiO_2$ oxide (Aerosil 130 from Degussa), with moderate stirring.

The composition of the hydrogel thus prepared, with respect to one mole of oxide $SiO_2$, was:

$$1.0SiO_2;\ 0.44Al_2O_3;\ 0.25NH_4F;\ 0.15HF;\ 48H_2O$$

giving, in molar terms:

| | |
|---|---|
| Si/Al | = 1.136 |
| $NH_4^+$/Si | = 0.25 |
| F/Si | = 0.40 |
| HF/Si | = 0.15 |
| $H_2O$/Si | = 48 |

This composition did not take into account the water provided by the aluminium source and the acid HF.

The hydrogel obtained was aged for 4 hours at ambient temperature (20° C.) with moderate stirring. The pH was close to 5.

Crystallisation was then carried out at 220° C. in a 120 ml steel autoclave lined with a Teflon coating, under autogenous pressure, for 168 hours, without stirring. The autoclave was then cooled in air. The pH at the end of the synthesis was about 5.5.

The product was recovered, filtered and washed with copious quantities of distilled water. It was then dried at 40–50° C. for 24 hours. After 24 hours, the product obtained, with 50% relative humidity, was characterised by its X ray diffraction spectrum, shown below (Table 1).

TABLE 1

| $d_{hkl}$ ($10^{-10}$ m) | $I/I_0$ |
|---|---|
| 10.87 | 73 |
| 5.32 | 12 |
| 4.46 | 100 |
| 2.58 | 30 |
| 2.56 | 43 |
| 2.2 | 46 |
| 2.1 | 77 |
| 2.0 | 77 |
| 1.69 | 11 |
| 1.49 | 22 |

The fluorine content of the phyllosilicate obtained was 2.9% by weight. $^{19}F$ NMR with magic angle spinning of the phyllosilicate prepared in this example showed that a signal was present at −133 ppm.

The prepared dioctahedral 2:1 phyllosilicate was termed PD2. This latter then underwent a bridging step as described in the operating protocol below.

8 g of the prepared dioctahedral 2:1 phyllosilicate PD2 in its ammonium form was suspended in 80 ml of a hexadecyltrimethylammonium (CTMA-CI) solution with a concentration of 0.1 M. After stirring for one hour at room temperature, it was filtered, washed with twice 200 ml of distilled water then dried at 60° C. for 8 hours. The PD2 sample previously treated with CTMA was suspended in a mixture composed of 4.48 g of octylamine ($C_8H_{17}NH_2$) and 60.32 g of ethyl tetraorthosilicate $Si(OEt)_4$, and 2.96 g of aluminium isopropoxide After 30 minutes stirring, it was filtered then dried at 60° C. for 8 hours. The sample was calcined at 530° C. for 3 hours in air then for 2 hours in pure oxygen.

The $d_{001}$ of the sample after calcining was $31.2\times\times10^{-10}$ m (3.12 nm) and its specific surface area was 375 $m^2/g$.

The prepared dioctahedral 2:1 phyllosilicate was termed PDP2.

The weight content of bridged clay (bridged dioctahedral 2:1 phyllosilicate) in the finished catalyst was 60% and the amount of palladium introduced into the support by dry impregnation was 0.55% by weight.

Example 4

Evaluation of Catalysts C1 and C2 on a Hydrocracking Residue Catalysts C1 and C2 were Evaluated by Treating a Hydrocracking Residue from a Vacuum Distillate The feed had the following characteristics:

| | |
|---|---|
| Sulphur content (ppm by weight) | 13 |
| Nitrogen content (ppm by weight) | 2 |
| Pour point (° C.) | +37 |
| Initial boiling point | 277 |
| 10% | 343 |
| 50% | 410 |
| 90% | 463 |
| End point | 538 |

Catalysts C1 and C2 prepared as described above in Examples 1 and 2 were used to prepare a base stock from the feed described above.

The catalyst had been reduced in hydrogen at 450° C. prior to the catalytic test, in situ in the reactor. This reduction was carried out in stages. It consisted of a stage at 150° C. for 2 hours, then an increase of the temperature to 450° C. at a rate of 1° C./min, then a stage of 2 hours at 450° C. During this reduction procedure, the hydrogen flow rate was 1000 liters of $H_2$ per liter of catalyst.

For catalyst C1, the reaction took place at 275° C. at a total pressure of 12 MPa, an hourly space velocity of 1 $h^{-1}$ and at a hydrogen flow rate of 1000 liters of $H_2$ per liter of feed. For catalyst C2, the reaction took place at 285° C., the other operating conditions being identical to those used to test catalyst C2.

The characteristics of the oil obtained are shown in the following table.

| | Catalyst C1 | Catalyst C2 |
|---|---|---|
| Viscosity index VI | 118 | 121 |
| Pour point (° C.) | −13° C. | −15° C. |
| Oil yield (weight %) | 68 | 72 |

These examples show the advantage of the process of the invention which can reduce the pour point of the initial feed in the case of a hydrocracking residue, while retaining a high viscosity index (VI).

All references referred to herein are hereby incorporated by reference.

It is to be understood that the examples herein are meant to be only illustrative of the invention, and not representative of the entire scope of the invention.

Although the invention has been described above in relation to preferred embodiments thereof, it will be readily understood by those skilled in the art that variations and modifications can be affected in those embodiments without departing from the scope and spirit of the invention.

What is claimed is:

1. A process for improving the pour point of hydrocarbon feeds, wherein the feeds are comprised of paraffins containing more than 10 carbon atoms, comprising:

bringing the feed into contact with a catalyst containing at least one dioctahedral 2:1 phyllosilicate and at least one hydrodehydrogenating element in the metallic form, wherein the phyllosilicate is in the form of sheets and has an interplanar distance of at least $2.00\times10^{-9}$ m.

2. A process according to claim 1, wherein the space between the phyllosilicate sheets comprises pillars based on at least one oxide of at least one element selected from elements from groups IVB, VB, VIB, VIII, IB, IIB, IIA and IVA.

3. A process according to claim 2, wherein the pillars are based on at least one oxide selected from the group $SiO_2$, $Al_2O_3$, $TiO_2$, $ZrO_2$ and $V_2O_5$.

4. A process according to claim 1, wherein the phyllosilicate contains fluorine.

5. A process according to claim 2, wherein the interplanar distance is at least $2.65\times10^{-9}$ m.

6. A process according to claim 2, wherein the interplanar distance is at least $3.0\times10^{-9}$ m.

7. A process according to claim 2, wherein the interplanar distance is at least $3.3\times10^{-9}$ m.

8. A process according to claim 1, wherein the catalyst further comprises at least one compound selected from alumina, silica, magnesia, titanium oxide, zirconia, titanium phosphates, zirconium phosphates, boron oxide and charcoal.

9. A process according to claim 1, wherein the hydrodehydrogenating element is a group VIII noble metal.

10. A process according to claim 9, wherein the element is selected from platinum and palladium.

11. A process according to claim 1, wherein the process is carried out at 170–500° C., at 1–250 bars, at an hourly space velocity of 0.05–100 $h^{-1}$, and in the presence of 50–2000 liters of hydrogen per liter of feed.

12. A process according to claim 1, wherein the feed is selected from kerosenes, jet fuels, middle distillates, vacuum residues, gas oils, FCC middle distillates, hydrocracking residues, base stock, synthesized paraffins from the Fischer-Tropsch process, polyalphaolefins, synthesized oils and n-alkylcycloalkanes.

13. A process according to claim 1, wherein said catalyst comprises:

at least one dioctahedral 2:1 phyllosilicate, and at least one hydrodehydrogenating element in the metallic form, wherein the phyllosilicate is in the form of sheets and has an interplanar distance of at least $3.3\times10^{-9}$ m, wherein the space between the phyllosilicate sheets comprises pillars based on at least one oxide selected from the group $SiO_2$, $Al_2O_3$, $TiO_2$, $ZrO_2$ and $V_2O_5$, wherein the phyllosilicate contains fluorine, wherein the hydrodehydrogenating element is platinum or palladium, and wherein the catalyst further comprises at least one compound selected from alumina, silica, magnesia, titanium oxide, zirconia, titanium phosphates, zirconium phosphates, boron oxide and charcoal.

14. A process according to claim 1, wherein said feed contains paraffins having 15 to 50 carbon atoms.

15. A process according to claim 1, wherein the hydrodehydrogenation element is Fe, Co, Ni, Ru, Rh, Pd, Os, Ir, or Pt, or is a combination of at least one group VIII, non noble, metal or compound and at least one group VIB metal or compound.

16. A process according to claim 1, wherein said catalyst further contains a matrix.

17. A process according to claim 4, wherein the mole ratio $F/Si=y/(4-x)$ in the phyllosilicate is 0.1 to 4.

18. A process according to claim 1, wherein said hydrodehydrogenating element is a combination of at least one group VI metal or compound and at least one group VIII metal or compound, wherein the total concentration of group VI and group VIII metals, expressed as the metal oxides with respect to the support, is 5% to 40% by weight, and the weight ratio, expressed as the metallic oxides, of group VIII metals to group VI metals is 0.05 to 0.8.

19. A process according to claim 1, wherein the catalyst contains phosphorous in an amount less than 15% by weight, expressed as phosphorous oxide $P_2O_5$, with respect to the support.

20. A process according to claim 1, wherein the feed to be treated is a cut with an initial boiling point of more than about 175° C.

21. A process according to claim 1, wherein the reaction is conducted at a temperature of 170° C. to 500° C. and a pressure of 1 to 250 bar, and the hourly space velocity, expressed as the volume of feed injected per unit volume of catalyst per hour is 0.05–100 $h^{-1}$.

22. A process according to claim 1, wherein the feed and the catalyst are brought into contact in the presence of hydrogen, and the amount of hydrogen used, expressed in liters of hydrogen per liter of feed, is 50–2000.

23. A process according top claim 1, wherein the quantity of nitrogen compounds in the feed to be treated is less than about 200 ppm by weight, the sulphur content of the feed is below 1000 ppm by weight, and the quantity of metals in the feed is less than 50 ppm by weight.

24. A process according to claim 1, wherein the feed undergoes an initial hydrotreatment.

25. A process according to claim 1, wherein said dioctahedral 2:1 phyllosilicates, before bridging, is of the formula:

$$M^{m+}_{x/m}((Si_{(4-x)}T_x(T_2\square_1)O_{10}(OH_{(2-y)}F_y)^{x-}$$

wherein

T is B, Al, Ga, or iron;

M is at least one compensating cation selected from the group formed by cations of elements from groups IA, IIA, and VIII, organic cations containing nitrogen, the ammonium cation, and rare earth cations;

m is the valency of cation M;

x is a number in the range 0 to 2, preferably in the range 0.1 to 0.8;

y is greater than 0 and 2 or less; and

□ represents an octahedral cavity.

26. A process according to claim 13, wherein said dioctahedral 2:1 phyllosilicates, before bridging, is of the formula:

$$M^{m+}_{x/m}((Si_{(4-x)}T_x(T_2\square_1)O_{10}(OH_{(2-y)}F_y)^{x-}$$

wherein

T is B, Al, Ga, or iron;

M is at least one compensating cation selected from the group formed by cations of elements from groups IA, IIA, and VIII, organic cations containing nitrogen, the ammonium cation, and rare earth cations;

m is the valency of cation M;

x is a number in the range 0 to 2, preferably in the range 0.1 to 0.8;

y is greater than 0 and 2 or less; and

□ represents an octahedral cavity.

27. A process according to claim 1, wherein catalyst is prepared by a process comprising:

suspending dioctahedral 2:1 phyllosilicate in a solution of a surfactant with a concentration in the range 0.01 mole/liter to 1 mole/liter, after a contact period of 5 minutes–12 hours, during which the suspension stirred, filtering the suspension, washing with distilled water, and drying in air or an inert gas at a temperature of 40° C. to 150° C. for a period of 5 minutes to 24 hours, contacting the dioctahedral 2:1 phyllosilicate with a mixture comprising:

(i) at least one $RNH_2$ type primary amine or a R'RNH secondary amine, where R' and R are carbon-containing groups having 1 to 16 carbon atoms;

(ii) at least one alkoxide of an element or a mixture of alkoxides, the element being selected from groups IVB, VB, VIB, VIII, IB, IIB, said alkoxides being of the formula $M(OR)_n$, where M is said element, n is the valency of said element, and R is in each case independently alkyl, isoalkyl, naphthenyl or an aromatic, wherein contacting is conducted for a period of 5 minutes to 12 hours, filtering the resultant bridged dioctahedral 2:1 phyllosilicate, and drying in air or in an inert gas at a temperature of 40° C. to 150° C. for a period of 5 minutes–24 hours, and calcining at a temperature of 450–800° C.

28. A process according to claim 14, wherein said feed contains paraffins having 15 to 40 carbon atoms.

29. A process according to claim 15, wherein the hydrodehydrogenation element is a combination of at least one group VIII, non noble, metal or compound and at least one group VIB metal or compound.

30. A process according to claim 1, wherein said feed has an initial boiling point of at least 280° C.

31. A process according to claim 1, wherein said feed has an initial boiling point of at least 380° C.

32. A process according to claim 1, wherein said feed has a pour point of more than 0° C.

33. A process according to claim 1, wherein after said feed is contacted with said catalyst it has a pour point of below 0° C.

34. A process according to claim 1, wherein after said feed is contacted with said catalyst it has a pour point of below −10° C.

35. A process according to claim 1, wherein said feed contains more than 30 wt % of paraffins containing more than 10 carbon atoms.

36. A process according to claim 1, wherein said feed contains more than 60 wt % of paraffins containing more than 10 carbon atoms.

* * * * *